US006014018A

United States Patent [19]

Wu et al.

[11] Patent Number: 6,014,018

[45] Date of Patent: Jan. 11, 2000

[54] VOLTAGE-REDUCING DEVICE WITH LOW POWER DISSIPATION

[75] Inventors: Te-Sun Wu, Hsinchu; Hui-Fang Tsai, Hsinchu Hsien; Tsun-Zu Lin, Hsinchu, all of Taiwan

[73] Assignee: United Microelectronics Corp., Hsinchu, Taiwan

[21] Appl. No.: 09/177,205

[22] Filed: Oct. 22, 1998

[30] Foreign Application Priority Data

Jun. 19, 1998 [TW] Taiwan ..... 87109853

[51] Int. Cl.[7] ..... G05F 1/40

[52] U.S. Cl. ..... 323/265

[58] Field of Search ..... 363/62; 323/265, 323/273, 282; 327/534, 538, 543, 544; 326/35, 36

[56] References Cited

U.S. PATENT DOCUMENTS 3,935,478 1/1976 Okada et al. ..... 307/229
5,734,290 3/1998 Chang et al. ..... 327/536
5,777,491 7/1998 Hwang et al. ..... 326/113
5,831,844 11/1998 Sudo ..... 33/60

*Primary Examiner*—Matthew Nguyen
*Attorney, Agent, or Firm*—Hickman Stephens & Coleman, LLP

[57] ABSTRACT

A voltage-reducing device of low power dissipation is provided, including a plurality of transistors, which are self-connected as diode equivalent. These transistors are then cascaded in series in the same direction and coupled to a voltage source. Since every transistor has a threshold voltage, the voltage at the end of the forward-biased cascaded transistors will be lowered than the voltage source so as to provide a reduced voltage source. Furthermore, since the voltage adjustment of the device is based on the threshold voltage, there is hardly any power dissipation. In addition, we can use different threshold voltages from various transistors to provide different combinations of these threshold voltages to obtain the desired voltage drop.

13 Claims, 4 Drawing Sheets

300

VOLTAGE-REDUCING DEVICE WITH LOW POWER DISSIPATION

CROSS-REFERENCE TO RELATED APPLICATION

This application claims the priority benefit of Taiwan application serial no. 87109853, filed Jun. 19, 1998, the full disclosure of which is incorporated herein by reference.

BACKGROUND OF THE INVENTION

1. Field of Invention

The present invention relates to a voltage-reducing device, and more particularly, to a device connecting to a voltage source, which device provides a reduced voltage suitable for use in the manufacturing processes of semiconductor elements.

2. Description of Related Art

With the steady improvement in semiconductor technologies, the dimensions of IC devices are greatly reduced thanks to higher integration density. The primary objective in the manufacturing of semiconductor elements now becomes the efficient utilization of a limited space so that more elements can be incorporated into an IC device.

Refer to FIG. 1, which shows a circuit diagram of a static random access memory (SRAM) cell designed using a well-known NMOS technology. This SRAM cell is implemented using 4 transistors, M1, M2, M3 and M4. Transistors M1 and M2 are driving transistors, while transistors M3 and M4 are used for data access in the memory. As shown in FIG. 1, transistors M1 and M2 are coupled to a biased voltage source $V_{cc}$, while transistors M3 and M4 have their gates coupled to a word line. The voltage of the word line, which is for data access, is also 5 volts. Since the operation of the SRAM is not our concern in this invention, it is not described herein. Note that, however, the voltage used by every transistor in this circuit is 5 volts. Thus, the design rule for every transistor is the same.

FIG. 2 shows a circuit diagram of a SRAM cell designed using a well-known CMOS technology. The structure of this circuit is the same as FIG. 1, except that two PMOS transistors, M5 and M6, serve as the load. Hence, the same design rule applies to every transistor since the operation principles are the same as FIG. 1.

Generally speaking, transistors M3 and M4 need to be connected to a word line. They are therefore required to tolerate the voltage from the voltage source (5 volts for example). However, transistors M1 and M2 used as driving transistors need not be constrained by this condition, and are allowed to adopt a lower biased voltage (3 volts for example) to perform well. Unfortunately, this characteristic is always neglected, and the same design rule for every transistor is employed instead, which therefore increases the dimension of the SRAM cell and reduces the space utilization efficiency within a die.

In another aspect, it is well-known that a different circuit structure or layout can be used to implement a particular design object. It is quite normal that several versions of a die with the same functions are screened by comparing their characteristics so as to find a better design method before mass production. The most suitable die among the versions is then chosen for mass production. However, there is no an objective comparison base if these dies are produced on different wafers, since the ingredients and manufacturing environment for every wafer can be quite different. To minimize the errors due to environmental factors, different versions of a die are fabricated on the same wafer in practical application. Though this kind of arrangement is more objective for version comparison, it also causes difficulties for distinction when the dies are cut and mixed together.

In light of the foregoing, there is a need to provide a device to distinguish dies from different versions.

SUMMARY OF THE INVENTION

It is therefore an objective of the present invention to provide a voltage-reducing device with low power dissipation, which provides a reduced voltage so that appropriate design rules can be used for different semiconductor elements within a die according to practical needs. In this way, the integration density and space utilization efficiency can be increased so that the manufacturing costs can be reduced to make products more competitive.

It is another objective of the present invention to provide a device which employs an on-off connection method in the layout, where two transistors are cascaded in series and fabricated in every die to allow different versions of dies to be distinguished from each other.

In accordance with the foregoing and other objectives of the present invention, a voltage-reducing device with low power dissipation is provided. The device of the invention includes a plurality of transistors, which are self-connected by connecting the gate and the drain of the transistor to act as a diode equivalent. These transistors are then cascaded in series in the same direction and coupled to a voltage source. Since every transistor has a threshold voltage, the voltage at the end of the forward-biased cascaded transistors will be lower than that at the voltage source so as to provide a reduced voltage source. Furthermore, since the voltage adjustment of the device is based on the threshold voltage, there is hardly any power dissipation. In addition, we can use different threshold voltages from various transistors to provide different combinations of these threshold voltages to obtain the desired voltage drop.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
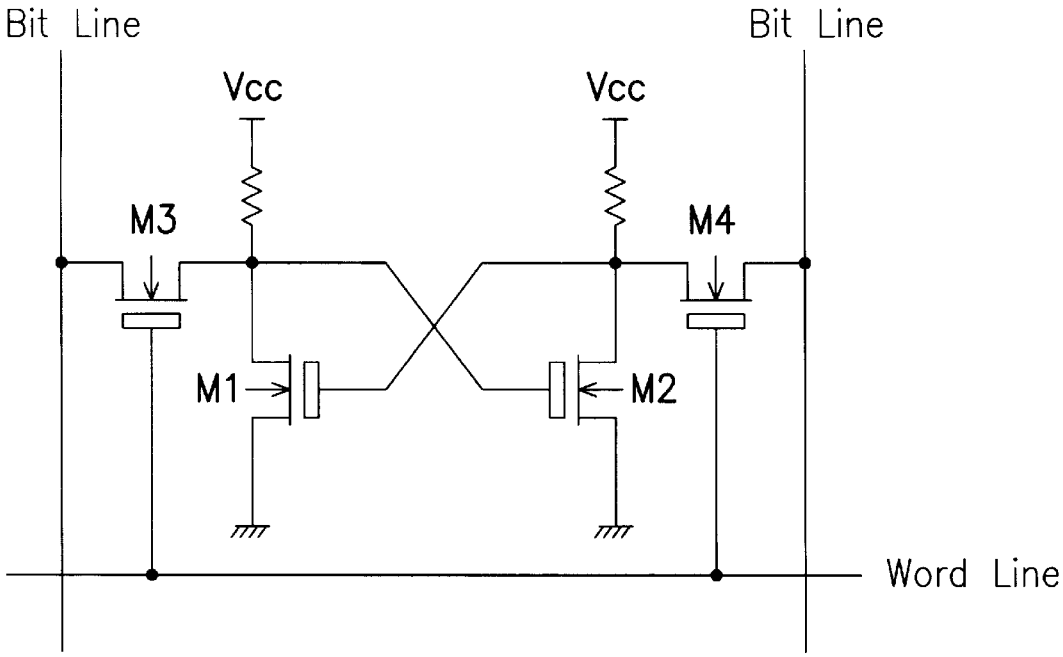
FIG. 1 (PRIOR ART)
FIG. 1 is a circuit diagram of a SRAM cell that uses NMOS technology.
Figure 2:
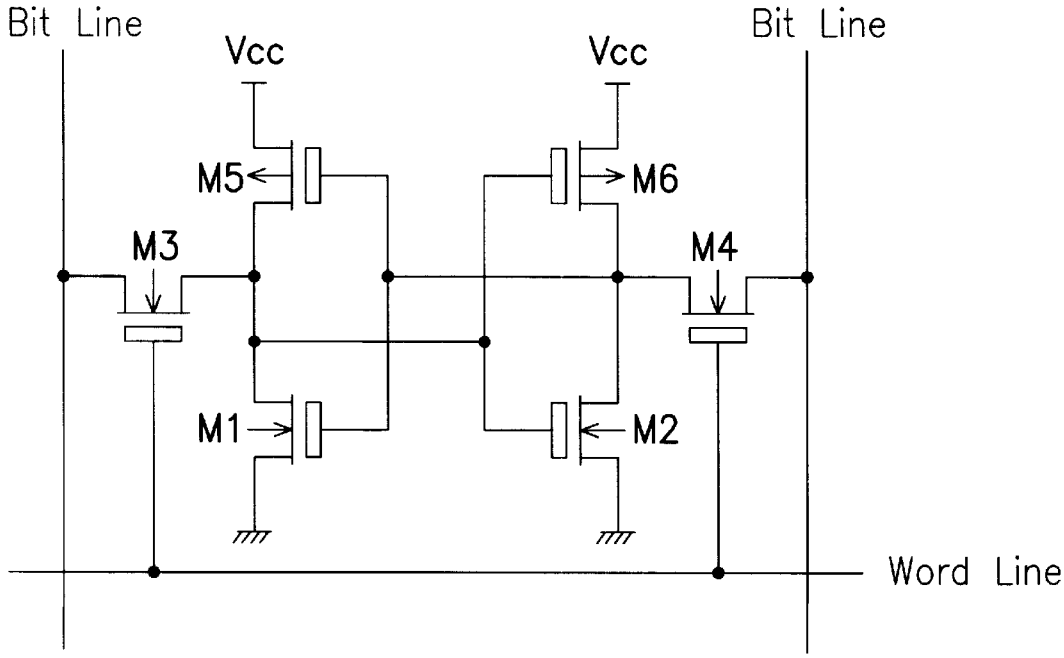
FIG. 2 (PRIOR ART)
FIG. 2 is a circuit diagram of a SRAM cell that uses CMOS technology.

Reference will now be made in detail to the present preferred embodiments of the invention, examples of which are illustrated in the accompanying drawings. Wherever possible, the same reference numbers are used in the drawings and the description to refer to the same or like parts.

Figure 3:
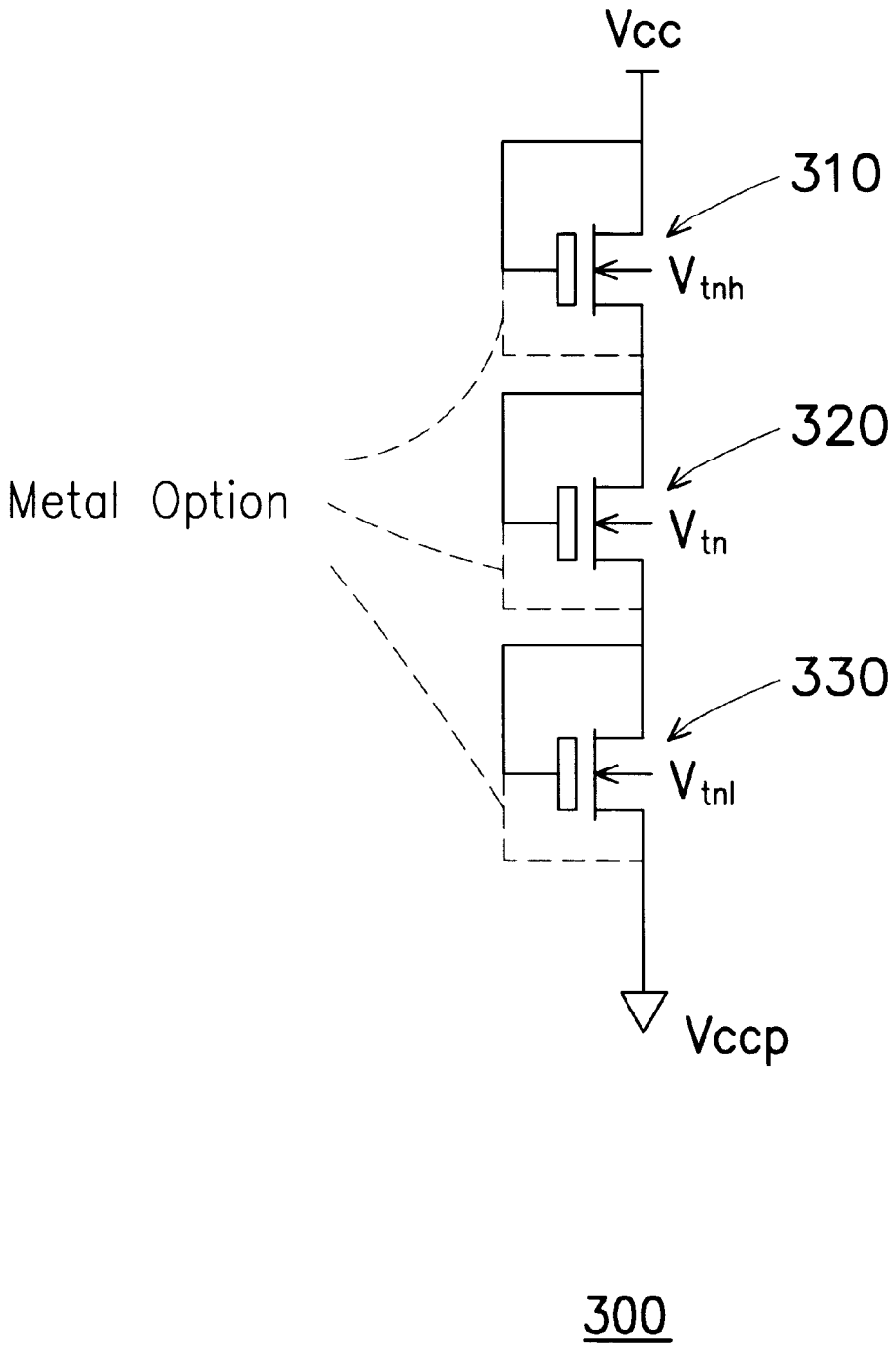
FIG. 3 is a schematic diagram used to depict a voltage-reducing device with low power dissipation as a preferred embodiment according to the invention.

Refer to FIG. 3, which shows a voltage-reducing device with low power dissipation for manufacturing semiconductor elements as a preferred embodiment of the present invention. The voltage-reducing device with low power dissipation 300 can be obtained by cascading several transistors in the same direction. For example, there are three different transistors used in this preferred embodiment. Note that transistors 310, 320, and 330 in the voltage-reducing device are self-connected by connecting the gate and drain of the transistor to act as a diode equivalent and then cascaded in series.

The self-connection of transistors acts as a diode equivalent, according to basic electronic principles. When the voltage across a transistor exceeds a threshold voltage, the transistor turns on. In this preferred embodiment, the threshold voltages for transistors 310, 320, and 330 are $V_{tnh}$, $V_{tn}$, and $V_{tnl}$, respectively. When the voltage source $V_{cc}$ is higher than the sum of $V_{tnh}$, $V_{tn}$, and $V_{tnl}$, a conducting current flowing from the voltage source $V_{cc}$ through transistors 310, 320, and 330 is produced and forms a reduced voltage source $V_{ccp}$, which is $V_{cc}-V_{tnh}-V_{tn}-V_{tnl}$. Also, the source and drain of the transistors can be connected to produce different combinations of the threshold voltages $V_{tnh}$, $V_{tn}$, and $V_{tnl}$. This kind of implementation can be realized via a metal option within the semiconductor. Note that identical transistors added to the structure by those skilled in the art to achieve the purpose similar to reduce voltage without departing from the scope or spirit of the invention should fall within the scope of the following claims and their equivalents.

Note also that the circuit structure in the present invention is quite flexible. For example, different transistors are cascaded together to obtain the desired voltage drop. Transistors with different threshold voltages can be used, such as bipolar junction transistors, field-effect transistors, metal-oxide-semiconductor field-effect transistors, or high-threshold-voltage transistors, to produce different combinations of voltage drop, according to practical requirements.

Figure 4:
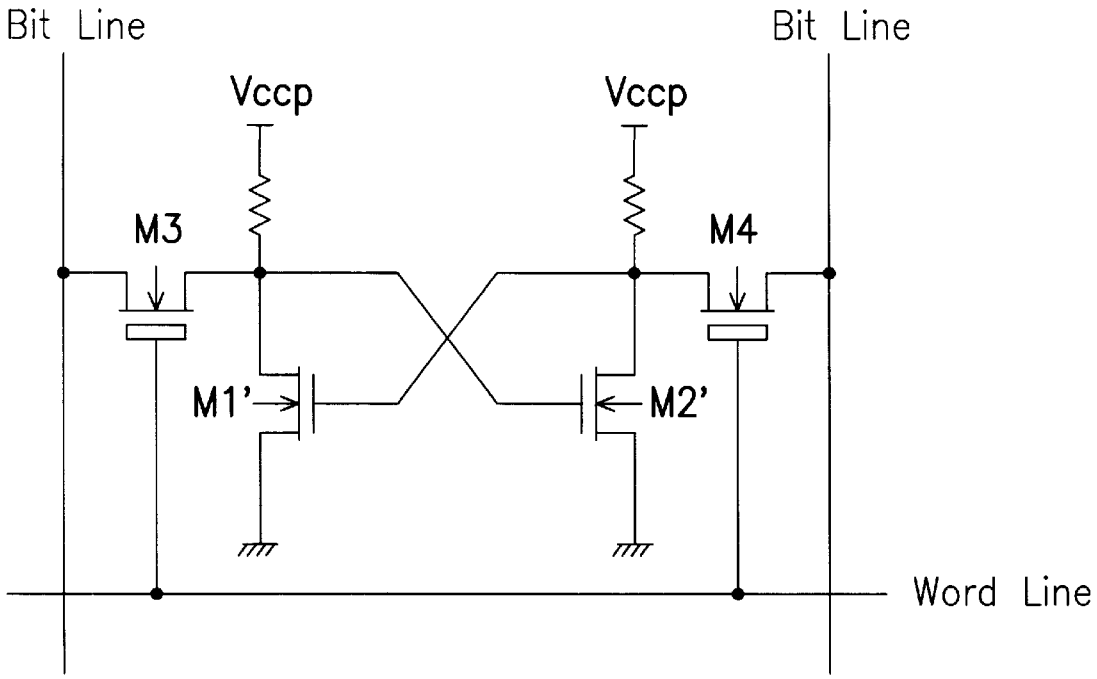
FIGS. 4 and 5 are circuit diagrams used to depict the implementation structure of a dual gate-oxide memory using the voltage-reducing device with low power dissipation.
Figure 5:
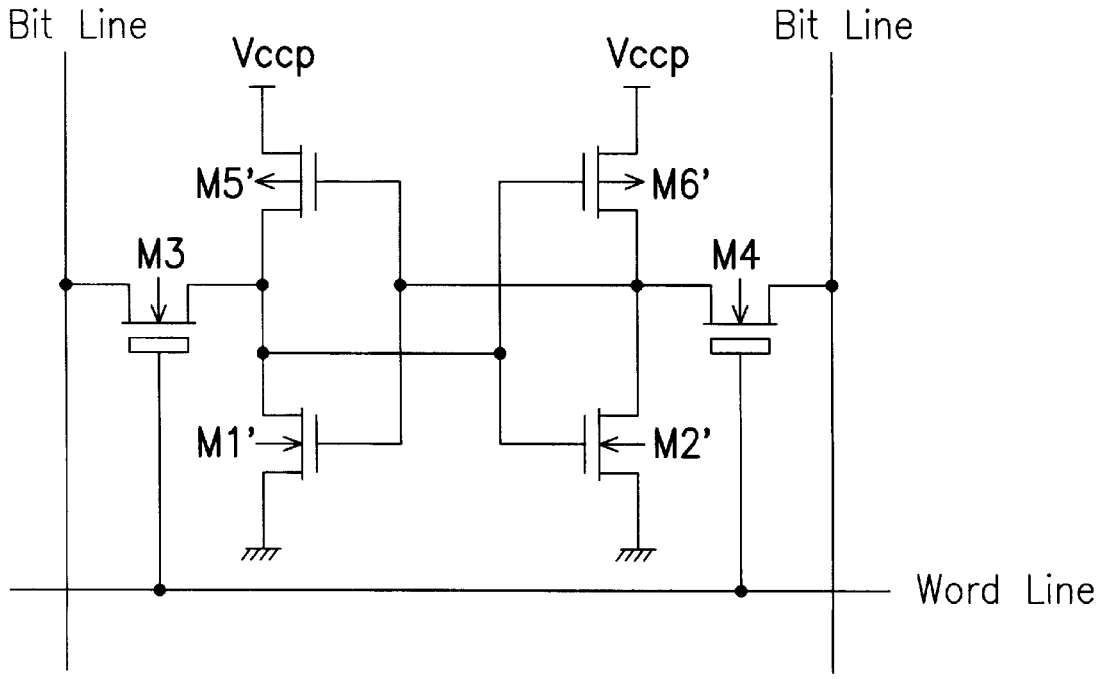

FIGS. 4 and 5 show the circuit diagrams of a dual gate-oxide memory realized using the voltage-reducing device illustrated in FIG. 3. FIG. 4 depicts a dual gate-oxide SRAM, in which the gates of the driving transistors M1 and M2 are coupled to the reduced voltage $V_{ccp}$ (3 volts for example). It is therefore possible to use a more compact design rule for the oxide layer of the gates. Transistors M3 and M4 remain using the original looser design rule. In this structure, the space required for a SRAM cell is significantly reduced, and the quantity of dies in a wafer is increased. Consequently, the manufacturing costs are reduced, which in turns increases the competitiveness of the products manufactured.

Similarly, the driving transistors M1, M2, M5 and M6 in FIG. 5 have their gates connected to the reduced voltage $V_{ccp}$ (3 volts for example). It is then possible to use a more compact design rule for the gate oxide layers for these transistors. Only transistors M3 and M4 still use the original, looser design rule.

Note that only one byte is selected when accessing the SRAM, and therefore a small current is required. Thus, only one voltage-reducing device is required for each section of SRAM cells, which takes up a very limited space in the circuit layout.

Figure 6:
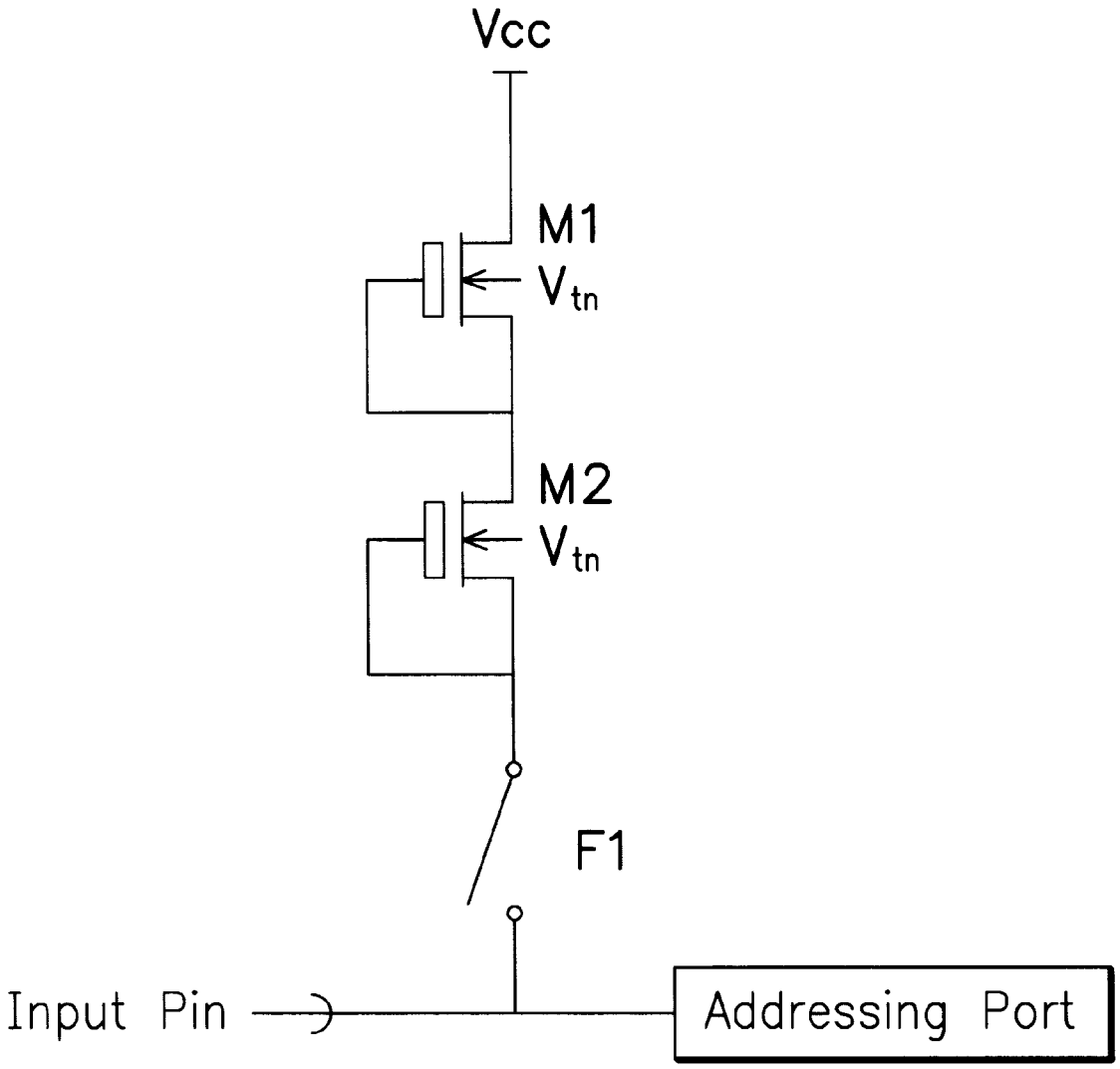
FIG. 6 is schematic diagram used to depict the implementation structure of version detection using a reverse connection of the voltage-reducing device with low power dissipation in FIG. 3.

In another aspect, the on-off connection in the layout can be used to connect the transistors in reverse, which implements the version detection function. FIG. 6 depicts a reverse connection of the voltage-reducing device to implement the version detection function when manufacturing of semiconductor devices. As shown in this figure, transistors M1 and M2 cascaded to the voltage source $V_{cc}$ are coupled to the input pin. There is an on-off switch F1 in the path, the on-off operations of which depend on the layout. If the transistors M1 and M2 are identical and have the same threshold voltage $V_{tn}$, and the voltage from the input pin is 2 $V_{tn}$ higher than the voltage source, a conducting current is produced, flowing from transistors M1 and M2 to the voltage source. Furthermore, if the on-off switch F1 is open, no current is produced, and even the voltage from the input pin is 2 $V_{tn}$ higher than the voltage source. Based on this principle, a version-detection function can be implemented, which is described as follows:

For example, there are three versions of a die on a wafer. Two address lines A0 and A1 are used to implement the version-detection function, in which the address lines A0 and A1 are coupled to the voltage source shown in FIG. 6. At this time, the on-off switch of different versions can be controlled by, for example, layout of the wafer, by which different versions can be distinguished from each other. Reference is made to Table 1, which shows the relationship between the on-off status of the switch and various versions.

TABLE 1

| | A0 | A1 |
|---|---|---|
| Version A | ON | ON |
| Version B | ON | OFF |
| Version C | OFF | ON |

Table 1 shows the on-off status of the switch. If the switch is not connected, an open circuit exists between the address line and the voltage source. When the device is used for version detection, the version of a die can be detected by checking the on-off status when two address line are connected with a voltage of higher than ($V_{cc}$+2 $V_{tn}$). Of course, other pins such as data lines can be used instead of the address lines to make the connection. Note that different quantities of various transistors added to the structure by those skilled in the art to achieve similar functions without departing from the scope or spirit of the invention should fall within the scope of the following claims and their equivalents.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage-reducing device of low power dissipation for a static random access memory (SRAM), comprising:

a plurality of transistors having different threshold voltages, each transistor having a first port, a second port, and a third port, wherein the transistors are self-connected by connecting the first port and the second port of the transistor to act as a diode equivalent, wherein the transistors are cascaded in series by connecting the third port of one transistor to the second port of an adjacent transistor, wherein the second port of one transistor is coupled to a voltage source and the third port of one transistor is coupled to an SRAM and serves as a reduced voltage source.

2. The device of claim 1, wherein the transistor comprises bipolar junction transistors.

3. The device of claim 2, wherein the first port of the transistor is a base.

4. The device of claim 2, wherein the second port of the transistor is a collector.

5. The device of claim 2, wherein the third port of the transistor is an emitter.

6. The device of claim 1, wherein the transistor comprises junction field-effect transistors and metal-diode-semiconductor field-effect transistors.

7. The device of claim 6, wherein the first port of the transistor is a gate.

8. The device of claim 6, wherein the second port of the transistor is a drain.

9. The device of claim 6, wherein the third port of the transistor is a source.

10. The device of claim 1, wherein the transistor includes high-threshold-voltage transistors.

11. The device of claim 1, wherein the transistor has a zero voltage drop by connecting the first port and the third port of the transistor via a metal option.

12. A SRAM having a voltage-reducing device of low power dissipation, comprising:

a first driving transistor and a second driving transistor, wherein the first driving transistor and the second driving transistor are coupled to a biased voltage source;

a third transistor and a fourth transistor for data access, wherein gates of the third transistor and the fourth transistor are coupled to a word line;

a plurality of cascaded transistors having different threshold voltages, each transistor having a first port, a second port, and a third port, wherein the transistors are self-connected by connecting the first port and the second port of the transistor to act as a diode equivalent, wherein the cascaded transistors are cascaded in series by connecting the third port of one transistor to the second port of an adjacent transistor, wherein the second port of one transistor is coupled to a voltage source, and the third port of one transistor is coupled to the first and second driving transistors serving as a reduced voltage source.

13. A SRAM having a voltage-reducing device of low power dissipation, comprising:

a first driving transistor and a second driving transistor, wherein the first driving transistor and the second driving transistor are coupled to a biased voltage source;

a third transistor and a fourth transistor for data access, wherein gates of the third transistor and the fourth transistor are coupled to a word line;

a fifth transistor and a sixth transistor serving as a load;

a plurality of cascaded transistors having different threshold voltages, each transistor having a first port, a second port, and a third port, wherein the transistors are self-connected by connecting the first port and the second port of the transistor to act as a diode equivalent, wherein the cascaded transistors are cascaded in series by connecting the third port of one transistor to the second port of an adjacent transistor, wherein the second port of one transistor is coupled to a voltage source, and the third port of one transistor is coupled to the first and second driving NMOS transistors serving as a reduced voltage source.

* * * * *